US011399681B2

(12) United States Patent
Wei et al.

(10) Patent No.: US 11,399,681 B2
(45) Date of Patent: Aug. 2, 2022

(54) TELESCOPIC TUBE DEVICE AND VACUUM CLEANER HAVING SAME

(71) Applicant: Skybest Electric Appliance (Suzhou) Co., Ltd., Suzhou (CN)

(72) Inventors: Juan Wei, Suzhou (CN); Liang Gu, Suzhou (CN)

(73) Assignee: Skybest Electric Appliance (Suzhou) Co., Ltd., Suzhou (CN)

( * ) Notice: Subject to any disclaimer, the term of this patent is extended or adjusted under 35 U.S.C. 154(b) by 130 days.

(21) Appl. No.: 16/634,660

(22) PCT Filed: Aug. 9, 2018

(86) PCT No.: PCT/CN2018/099546
§ 371 (c)(1),
(2) Date: Jan. 28, 2020

(87) PCT Pub. No.: WO2019/029603
PCT Pub. Date: Feb. 14, 2019

(65) Prior Publication Data

US 2021/0113041 A1 Apr. 22, 2021

(30) Foreign Application Priority Data

Aug. 9, 2017 (CN) ..... 201710674031.9
Dec. 28, 2017 (CN) ..... 201711454596.2

(51) Int. Cl.
*A47L 9/24* (2006.01)
*A47L 5/24* (2006.01)

(52) U.S. Cl.
CPC ..... *A47L 9/244* (2013.01); *A47L 5/24* (2013.01); *A47L 9/248* (2013.01)

(58) Field of Classification Search
USPC ... 15/344, 144.1, 144.3, 328, 335, 410, 414; 285/7, 145.1, 144.1, 298, 302, 303
See application file for complete search history.

(56) References Cited

U.S. PATENT DOCUMENTS 5,692,782 A * 12/1997 Fischer ..... A47L 9/244 285/24
6,513,191 B1 * 2/2003 Kim ..... A47L 9/244 15/414

(Continued)

FOREIGN PATENT DOCUMENTS

CN 2449639 Y 9/2001
CN 201870570 U 6/2011

(Continued)

OTHER PUBLICATIONS

International Search Report for Application No. PCT/CN2018/099546, dated Oct. 8, 2018.

*Primary Examiner* — Brian D Keller
*Assistant Examiner* — Dana Lee Poon
(74) *Attorney, Agent, or Firm* — JK Intellectual Property Law, PA

(57) ABSTRACT

A telescopic tube device includes a first tube assembly, a second tube assembly slidably connected relative to the first tube assembly, and an operating unit disposed at a sleeved position between the first tube assembly and the second tube assembly. The operating unit includes an operating member, a first locking member, a second locking member, and a limiting member. When in a locked state, the limiting member is at an initial position, and the first locking member and the second locking member remain engaged; when in at least one released state, the limiting member is offset from the initial position, and the first locking member and the second locking member are disengaged. At least one elastic member provides the limiting member with a pulling force so that the limiting member has a tendency to remain at the initial position. A related vacuum cleaner is disclosed.

14 Claims, 11 Drawing Sheets

(56) References Cited

U.S. PATENT DOCUMENTS

| | | | | |
|---|---|---|---|---|
| 2008/0284158 | A1* | 11/2008 | Lin | A47L 9/244 285/7 |
| 2010/0123305 | A1* | 5/2010 | Shih | A47L 9/244 285/7 |
| 2012/0126533 | A1* | 5/2012 | Canale | F16B 7/105 285/145.1 |
| 2016/0174799 | A1* | 6/2016 | Thorne | A47L 5/30 15/328 |

FOREIGN PATENT DOCUMENTS

| | | | |
|---|---|---|---|
| CN | 103263236 | A | 8/2013 |
| EP | 0552481 | A1 | 7/1993 |

* cited by examiner

TELESCOPIC TUBE DEVICE AND VACUUM CLEANER HAVING SAME

CROSS-REFERENCE TO RELATED PATENT APPLICATIONS

This application is a national stage of International Application No. PCT/CN2018/099546, filed on Aug. 9, 2018 which claims priority to CN Patent Application No. 201710674031.9, filed on Aug. 9, 2017 and CN Patent Application No. 201711454596.2, filed on Dec. 28, 2017. All of the aforementioned applications are hereby incorporated by reference in their entireties.

TECHNICAL FIELD

The present disclosure relates to a telescopic tube device, in particular to a telescopic tube device for a vacuum cleaner. The present disclosure also relates to a vacuum cleaner having the telescopic tube device.

BACKGROUND

In the prior art, there is a telescopic tube device which is provided with two springs and can have two pushing directions to achieve the functions of extension and retraction of a telescopic tube. For example, in Chinese Utility Model Patent CN 201870570 U, a spring is sandwiched between a positioning seat and a linkage portion, and two ends of the spring are not fixedly connected to the positioning seat or the linkage portion, which means that the used spring is a compression spring, and compression springs are substantially used in similar telescopic tube devices. However, the use of a compression spring will cause the problem of instability of the compression spring. The instability of the compression spring indicates that, when the load is too heavy, the compression spring may be bent laterally suddenly, causing the stiffness of the compression spring to decrease suddenly. In the prior art, the compression spring is not fixed, but is simply pressed by two components. During operation, when a push button is pushed too far, the compression spring on one side is instable, and the compression spring on the other side restores to a free length, where the loss of restoring force easily causes displacement. More importantly, in the phenomenon of instability of the compression spring, the height-diameter ratio is a parameter of stability of the compression spring. The height-diameter ratio (b) is a ratio of the free length (H0) of the compression spring to the mean diameter (d) of the compression spring. The mean diameter (d) of the compression spring refers to a mean value of the outer diameter (d1) and the inner diameter (d2) of the compression spring. The higher the height-diameter ratio (b) is, more likely the compression spring is to be instable. However, in the telescopic tube device, the tube diameter cannot be too large, that is, the height-diameter ratio of the compression spring is relatively high.

SUMMARY

The technical problem to be solved by the present disclosure is to provide a telescopic tube device with good stability.

In order to solve the above technical problem, a telescopic tube device of the present disclosure includes a first tube, a second tube slidably connected relative to the first tube, and an operating unit; the first tube is sleeved within the second tube; the operating unit is disposed at the sleeved position between the first tube and the second tube; the operating unit includes a first locking member, a second locking member and a limiting member; the first locking member is disposed on the first tube, the second locking member and the limiting member are disposed on the second tube, and the first locking member and the second locking member may be selectively engaged to limit relative sliding between the first tube and the second tube; when the telescopic tube device is in a locked state, the limiting member is at an initial position, and the first locking member and the second locking member remain engaged; when the telescopic tube device is in at least one released state, the limiting member is offset from the initial position, and the first locking member and the second locking member are disengaged; the operating unit further includes at least one elastic member; when the limiting member is at the initial position, the elastic member provides the limiting member with a pulling force so that the limiting member has a tendency to remain at the initial position.

The present disclosure also provides a vacuum cleaner including the telescopic tube device.

The present disclosure can achieve the technical effects that when a telescopic tube is operated, the technical problems caused by the use of a compression spring can be avoided: the push button is pushed too far, so that the middle of the compression spring is bent laterally in the pushing direction, that is, the compression spring is instable, and after the compression spring restores to a free length, the position is not fixed, and there is an offset of position.

DETAILED DESCRIPTION

Figure 1:
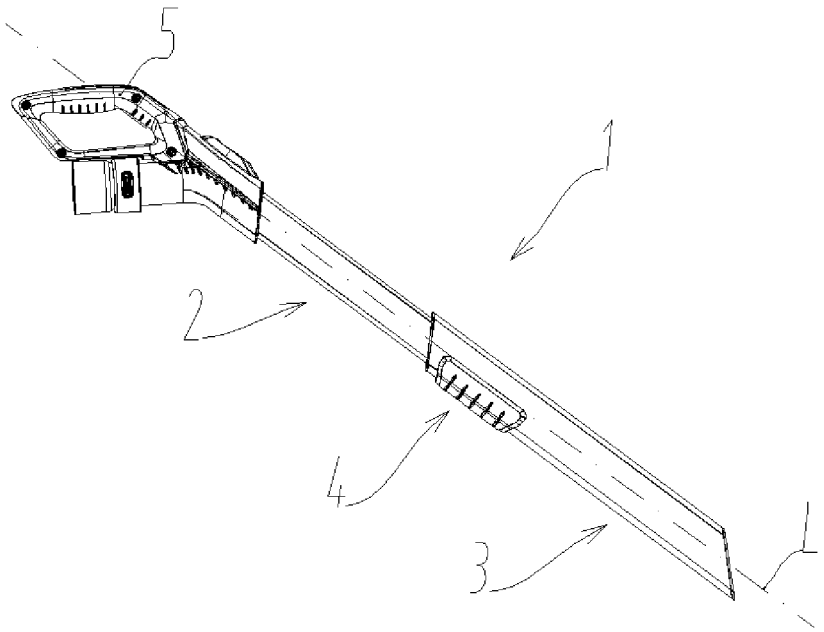
FIG. 1 is a schematic diagram of a telescopic tube according to a specific embodiment of the present disclosure.

The present disclosure will be described in detail below with reference to specific embodiments shown in the accompanying drawings. However, these embodiments do not limit the present disclosure. Structural, method, or functional modifications made by those skilled in the art based on these embodiments are all included within the protection scope of the present disclosure.

The present disclosure will be described in detail below with reference to the accompanying drawings and embodiments.

FIG. 1 to FIG. 23 show preferred embodiments of a telescopic tube device of the present disclosure. The telescopic tube device 1 includes a first tube assembly 2, a second tube assembly 3 slidably connected relative to the first tube assembly 2, and an operating unit 4.

The first tube assembly 2 is sleeved within the second tube assembly 3. In the embodiment, the first tube assembly 2 and the second tube assembly 3 have a radial central axis L, and can slide relative to each other along the extending direction of the axis L. The first tube assembly 2 includes a first tube body 21 made of metal, the first end of the first tube 201, the end being sleeved with the second tube assembly 3, and the second end of first tube 202, the end being opposite to the first end of the first tube 201. The first end of first tube 201 is provided with a first end sleeve 211. The first end sleeve 211 cooperates with the second tube assembly 3 for limiting to prevent the first tube assembly 2 and the second tube assembly 3 from disengaging from each other when sliding relative to each other. The second end of first tube 202 is provided with a second end sleeve 212. A handle assembly 5 is connected to the second end sleeve 212 for a user to conveniently hold the telescopic tube device 1. The second tube assembly 3 includes a second tube body 31 made of metal, the second end of the second tube 302, the second end being sleeved with the first tube assembly 2, and the first end of second tube 301, the first end being opposite to the second end of second tube 302.

The operating unit 4 is disposed at the sleeved position between the first tube assembly 2 and the second tube assembly 3. The operating unit 4 includes a first locking member, a second locking member, and a limiting member; the first locking member is disposed on the first tube assembly 2, the second locking member and the limiting member are disposed on the second tube assembly 3, and the first locking member and the second locking member may be selectively engaged to limit relative sliding between the first tube assembly 2 and the second tube assembly 3.

Figure 2:
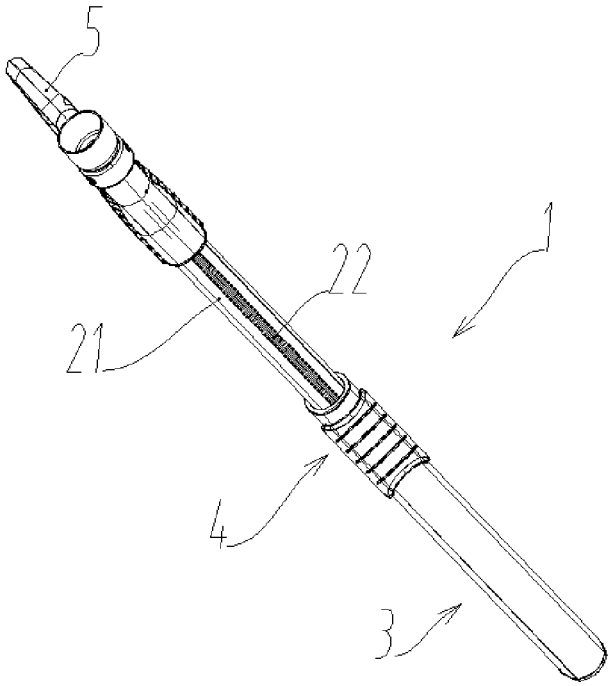
FIG. 2 is a schematic diagram of the telescopic tube according to a specific embodiment of the present disclosure from another perspective.
Figure 3:
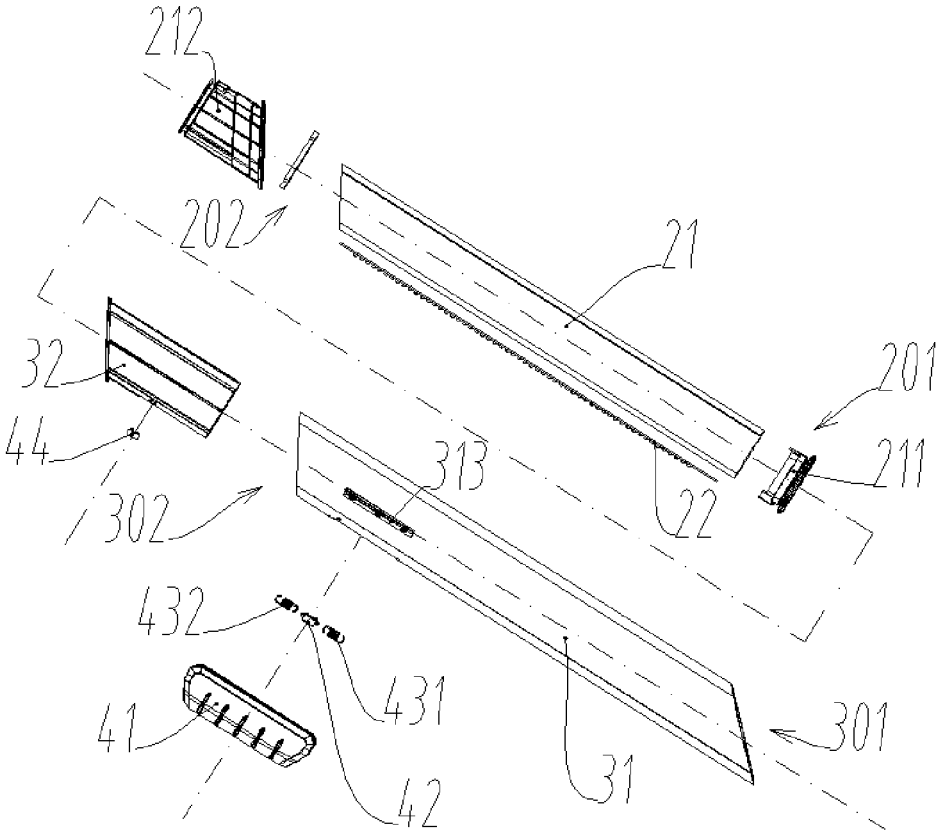
FIG. 3 is an exploded view of the telescopic tube according to a specific embodiment of the present disclosure.

In the embodiment, the first locking member is constructed as a strip-shaped slotted band 22 as shown in FIG. 2 and FIG. 3. Specifically, the slotted band 22 includes at least one concave locking slot 22*b*, and the slotted band 22 has a first surface and a second surface substantially parallel to the first surface. In the embodiment, a plurality of concave locking slots 22*b* distributed along the length direction are provided in the first surface of the slotted band 22, and a slot spacing portion 22*a* is formed between two adjacent locking slots 22*b*. The second surface of the slotted band 22 is attached to the outer circumferential surface of the first tube body 21, the slotted band 22 is connected to the first tube body 21 in a relatively fixed way, and the length direction of the slotted band 22 is substantially the same as the extending direction of the axis L. In other embodiments, the slotted band 22 and the first tube body 21 may be integrally provided. In the embodiment, the locking slots 22*b* are constructed as strip-shaped slots extending in a direction perpendicular to the axis L. In other embodiments, the locking slots 22*b* may also be constructed as dotted slots.

Figure 4:
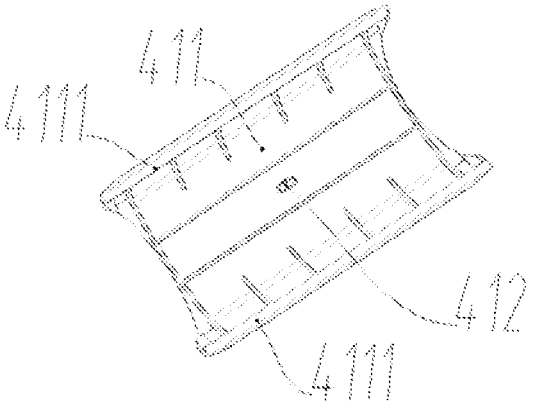
FIG. 4 is a schematic diagram of a push button according to a specific embodiment of the present disclosure.
Figure 5:
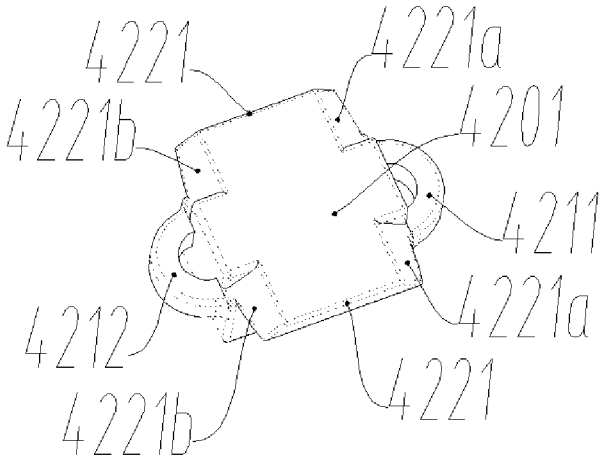
FIG. 5 is a schematic diagram of a slider according to a specific embodiment of the present disclosure.
Figure 6:
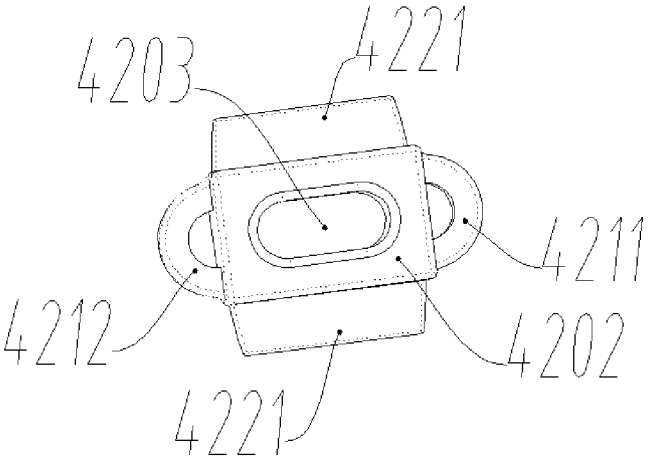
FIG. 6 is a schematic diagram of the slider according to a specific embodiment of the present disclosure from another perspective.
Figure 7:
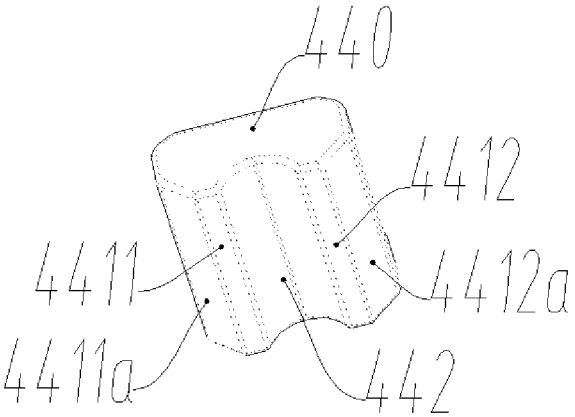
FIG. 7 is a schematic diagram of a locking block according to a specific embodiment of the present disclosure.
Figure 8:
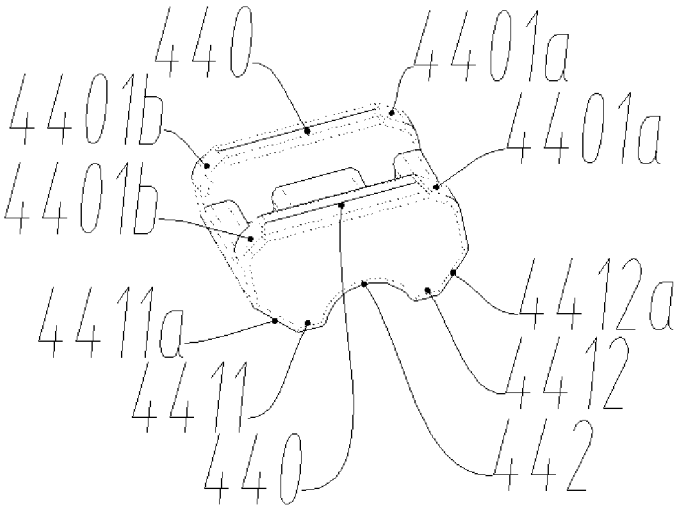
FIG. 8 is a schematic diagram of the locking block according to a specific embodiment of the present disclosure from another perspective.
Figure 9:
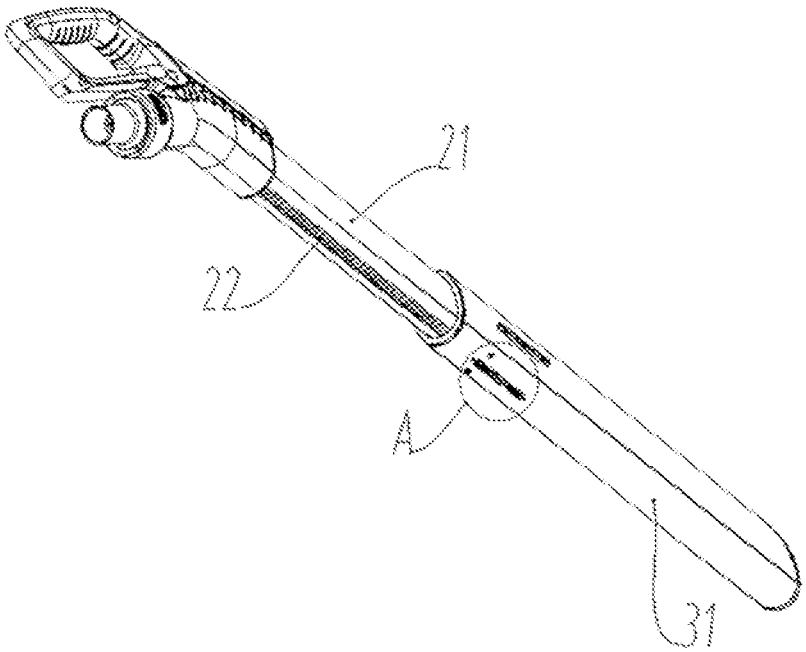
FIG. 9 is a schematic diagram of the telescopic tube according to a specific embodiment of the present disclosure, in which the push button is hidden.
Figure 10:
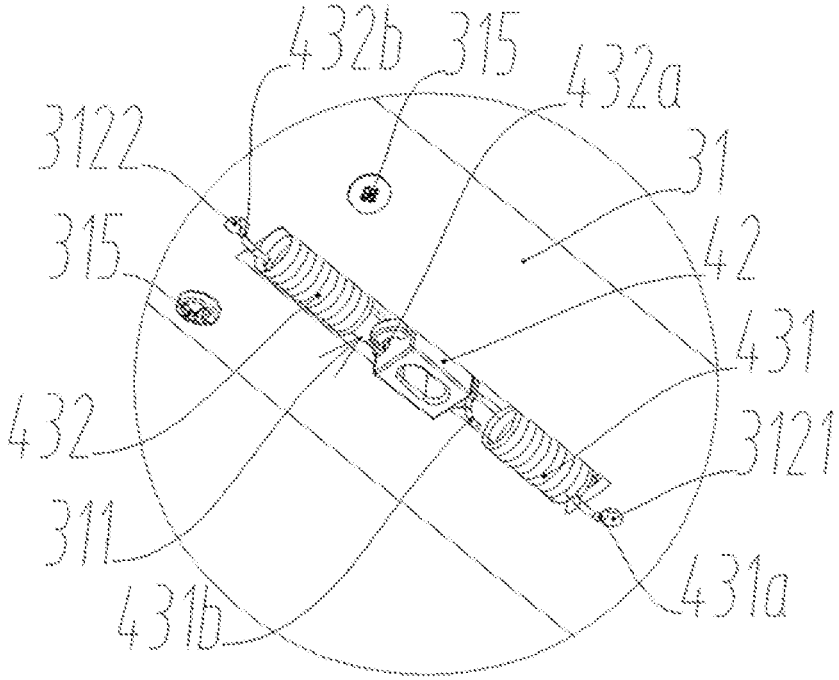
FIG. 10 is an enlarged view of area A in FIG. 9, in which the telescopic tube is in a locked state.
Figure 11:
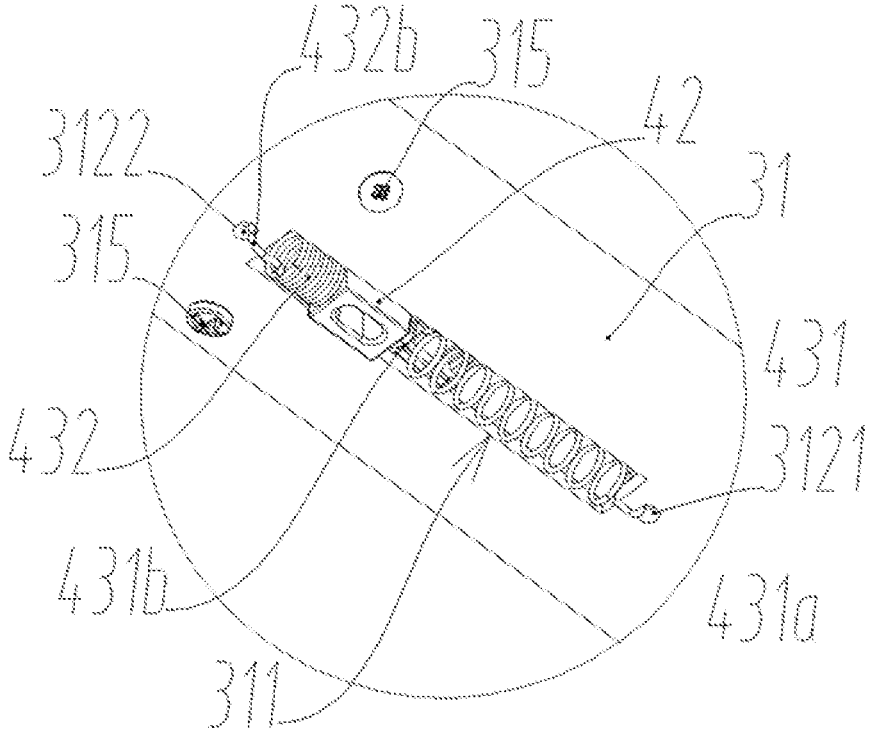
FIG. 11 is an enlarged view of area A in FIG. 9, in which the telescopic tube is in a first released state.

In the embodiment, the second locking member is constructed as a locking block 44 shown in FIG. 7 and FIG. 8, and the limiting member is constructed as a slider 42 shown in FIG. 5 and FIG. 6. The operating unit 4 further includes an operating member constructed as a push button 41 as shown in FIG. 3 and FIG. 4. Specifically, the second end of second tube 302 is provided with a liner 32 fixedly connected to the second tube body 31, the liner 32 is sleeved on the inner side of the second tube body 31, the side being near the second end of second tube 302, and the outer diameter of the liner 32 is smaller than the inner diameter of the second tube body 31, that is, there is a gap with the width h1 between the outer circumferential surface of the liner 32 and the inner circumferential surface of the second tube body 31.

Figure 18:
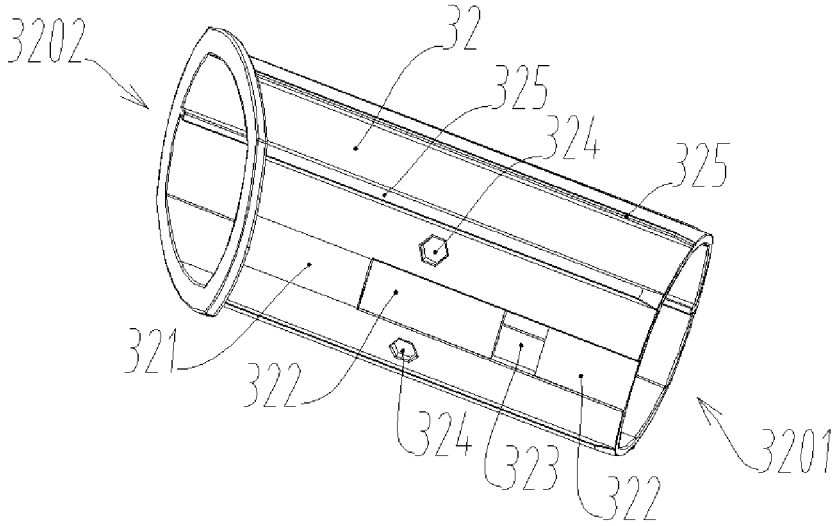
FIG. 18 is a schematic diagram of a liner.

As shown in FIG. 18, the liner 32 has a second end of the liner 3202, the end being near the second end of the second tube, and a first end of the liner 3201, the end being opposite to the second end of the liner 3202. The outer circumferential surface of the liner 32 is provided with a mating surface 321 extending along the axis of the surface, the end of the mating surface 321 is provided with a second slot 322, the end being near the first end of the liner 3201, the second slot 322 is constructed as a substantially rectangular non-through slot, and there is a height difference h2 between the bottom surface of the second slot 322 and the mating surface 321. The bottom surface of the second slot 322 is provided with a third slot 323, the third slot 323 is constructed as a through slot penetrating the bottom surface of the second slot 322, and the third slot 323 is closer to the end of the second slot 322, the end being near the first end of the liner 3201, than to the end of the second slot 322, the end being near the second end of liner 3202. When the first tube assembly 2 and the second tube assembly 3 slide relative to each other, the third slot 323 always corresponds to the slotted band 22. Nut slots 324 are symmetrically provided on two sides of the mating surface 321 in a direction perpendicular to the axis L. At least one raised rib 325 is also provided on the outer circumferential surface of the liner 32, the raised ribs 325 extend substantially along the axis L and from the first end of the liner 3201 to the second end of the liner 3202, and the height of the raised ribs 325 is equal to or slightly smaller than h1. When the liner 32 is fixedly connected to the second tube body 31, the raised ribs 325 are in the gap between the outer circumferential surface of the liner 32 and the inner circumferential surface of the second tube body 31 to enhance the connection stability and prevent relative waggle between the liner 32 and the second tube body 31.

Figure 19:
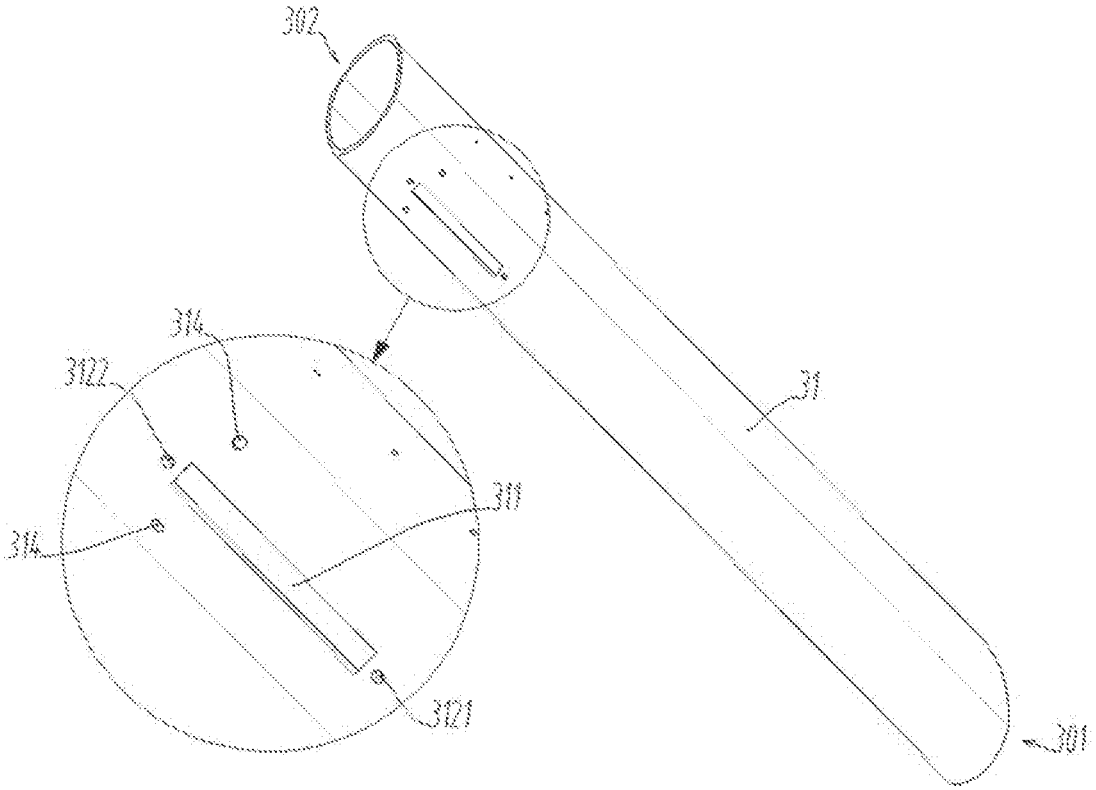
FIG. 19 is a schematic diagram of a second tube body and a partial enlarged view of a first slot.
Figure 20:
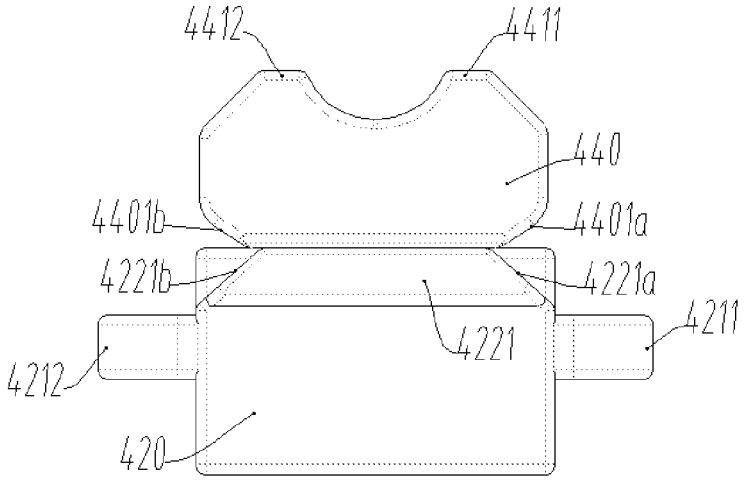
FIG. 20 is a schematic diagram indicating that the slider locks the locking block in the locked state.
Figure 21:
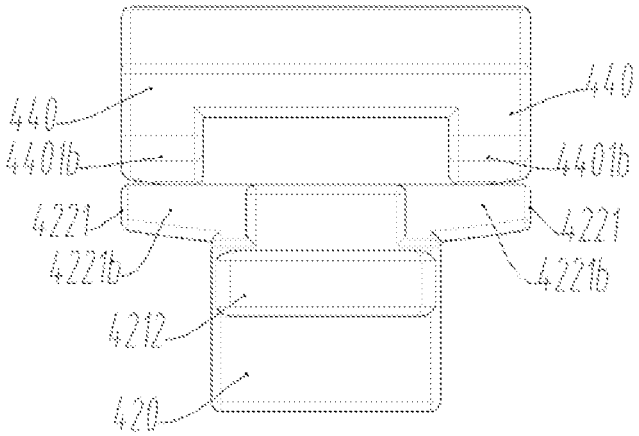
FIG. 21 is a schematic diagram indicating that the slider locks the locking block in the locked state from another perspective.
Figure 22:
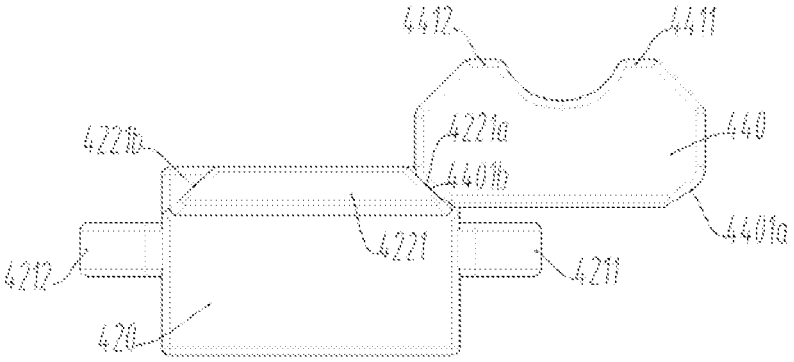
FIG. 22 is a schematic diagram indicating that the slider unlocks the locking block in the second released state.
Figure 23:
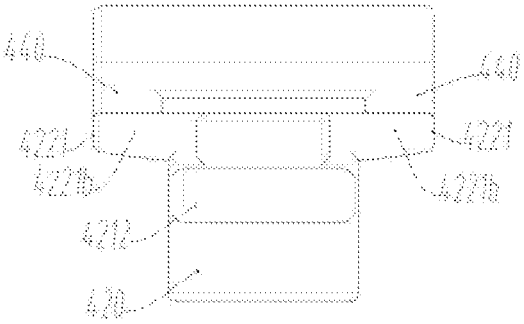
FIG. 23 is a schematic diagram indicating that the slider unlocks the locking block in the first/second released state from another perspective.

As shown in FIG. 19, a first slot 311 is provided in the wall of the second tube body 31, the wall being near the second end of the second tube 302, the first slot 311 is constructed as an elongated through slot penetrating the wall of the second tube body 31, and the length extending direction of the first slot 311 is identical to the extending direction of the axis L. Screw holes 314 are symmetrically provided in two sides of the first slot 311 along the circumferential direction of the second tube body 31. When the liner 31 is fixedly connected to the second tube body 31 by screws 315, the screws pass through the second tube body 31 and then are screwed with the nut slots 324. In the embodiment, a nut is fixedly disposed in the nut slots 324. In other embodiments, the inner circumferential wall of the nut slots 324 is provided with threads. In other embodiments, the liner 31 and the second tube body 31 may also be fixedly connected by other known means, such as riveting, gluing, etc., or integral formation. In the embodiment, when the liner 31 is fixedly connected to the second tube body 31, the position of third slot 323 substantially corresponds to the center of the first slot 311, the position of the second slot 322 substantially corresponds to the position of first slot 311, and the length extending direction of the second slot 322 is the same as that of the first slot 311. In the embodiment, both the first slot 311 and the second slot 322 are rectangular, the geometric center of the first slot 311 corresponds to that of the second slot 322, and the first slot 311 is narrower than the second slot 322 in the circumferential direction of the second tube body 31, that is, the orthographic projection of the first slot 311 falls within the orthographic projection of the second slot 322. In the embodiment, a pair of raised strips 313 is provided on the outer circumferential surface of the second tube body 31 and symmetrically on two sides of the first slot 311 in the circumferential direction of the second tube body 31. The length extending direction of the raised strips 313 is the same as the extending direction of the axis L. The raised strips 313 may be integrally formed with the second tube body 31, and may also be independent parts fixedly connected to the periphery of the second tube body 31.

Figure 17:
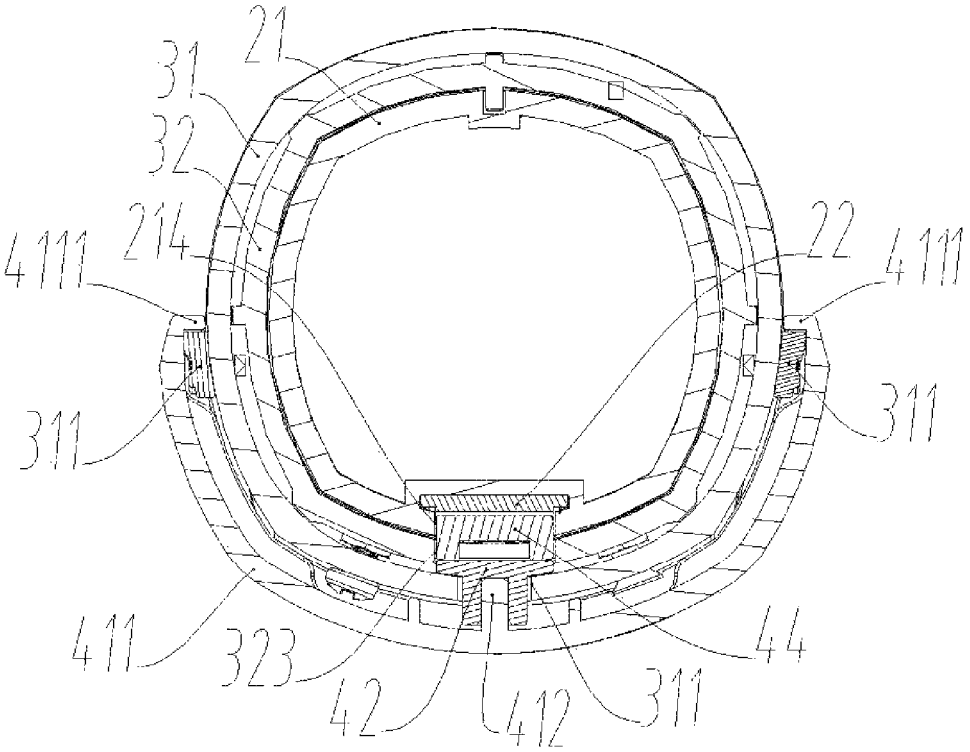
FIG. 17 is a sectional view along a P-P line in FIG. 14.

As shown in FIGS. 3 to 4 and 17, the push button 41 includes a push button body 411 having an arc-shaped cross section, and the shape of the push button body 411 is adapted to the outer circumferential surface of the second tube body 31. First connecting portions 4111 are symmetrically provided on two opposite sides of the push button body 411. Specifically, the first connecting portions 4111 are constructed as inward flanges extending substantially along the radial direction of the second tube body 31 and toward the axis L, the flanges having the edge of the push button body 411. The first connecting portions 4111 are engaged with the raised strips 313 to limit the sliding of the push button 41 in the extending direction of the axis L on the outer circumferential surface of the second tube body 31. A second connecting portion 412 is provided at a substantially central position of the surface of the push button body 411, the surface facing the second tube body 31, and the second connecting portion 412 is constructed as a protrusion extending from the surface of the push button body 411, the surface facing the second tube body 31, substantially along the radial direction of the second tube body 31 and toward the axis L. During the sliding process of the push button body 411, the second connecting portion 412 is always within the first slot 311.

As shown in FIGS. 3, 5, 6 and 17, the slider 42 is mounted in the first slot 311, and the width of the body of the slider 42 in the width extending direction of the first slot 311 is slightly smaller than the width of the first slot 311, so that the body of the slider 42 can be embedded in the first slot 311 and slide along the length of the first slot 311. The body of the slider 42 has a substantially-flat first surface of the slider 4201 and a second surface of the slider 4202 opposite to the first surface of the slider 4201. The first surface of the slider 4201 faces the liner 32, and the second surface of the slider 4202 faces the push button 41. A third connecting portion 4211 and a fourth connecting portion 4212 are symmetrically provided on two sides of the body of the slider 42 in the length extending direction of the first slot 311, and the third connecting portion 4211 and the fourth connecting portion 4212 are constructed as hollow rings. Fin portions 4221 are symmetrically provided on two sides of the body of the slider 42 in the width extending direction of the first slot 311, the fin portions 4221 are constructed as projecting portions that are substantially coplanar with the first surface of the slider 4201 and extend away from the slider 42, so that the maximum width of the slider 42 in the width extending direction of the first slot 311 is greater than the width of the first slot 311. When the slider 42 is mounted on the second tube body 31, the fin portions 4221 are in contact with the inner circumferential surface of the second tube body 31 to prevent the slider 42 from disengaging from the first slot 311 in a direction away from the axis L. In the embodiment, a fin portion first bevel 4221*a* and a fin portion second bevel 4221*b* are provided at two edges of the fin portion 4221 in the length extending direction of the first slot 311, and the thickness of the fin portions gradually reduces from the center to the edge thereof. A fifth connecting portion 4203 is provided at the approximate geometric center of the second surface of the slider 4202, the fifth connecting portion 4203 is constructed as a groove, and the shape and size of the groove are adapted to those of the second connecting portion 412. In the embodiment, the second connecting portion 412 can be inserted into the fifth connecting portion 4203. When the push button 41 is pushed by a user to slide along the axis of the second tube body 31, the push button 41 drives the slider 42 to slide in the first slot 311 by means of mating of the second connecting portion 412 and the fifth connecting portion 4203.

Figure 14:
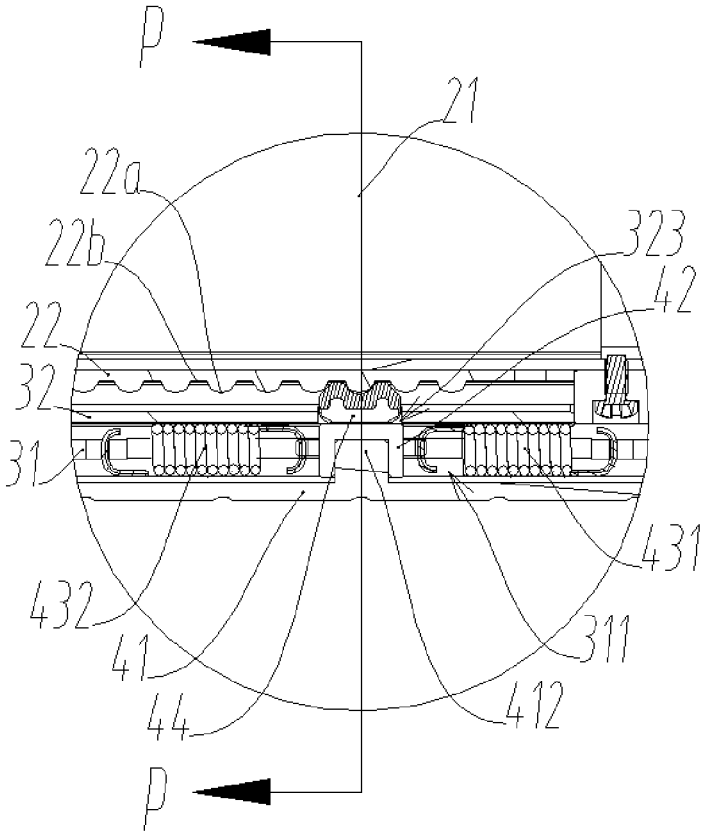
FIG. 14 is an enlarged view of area B in FIG. 13, in which the telescopic tube is in a locked state.
Figure 15:
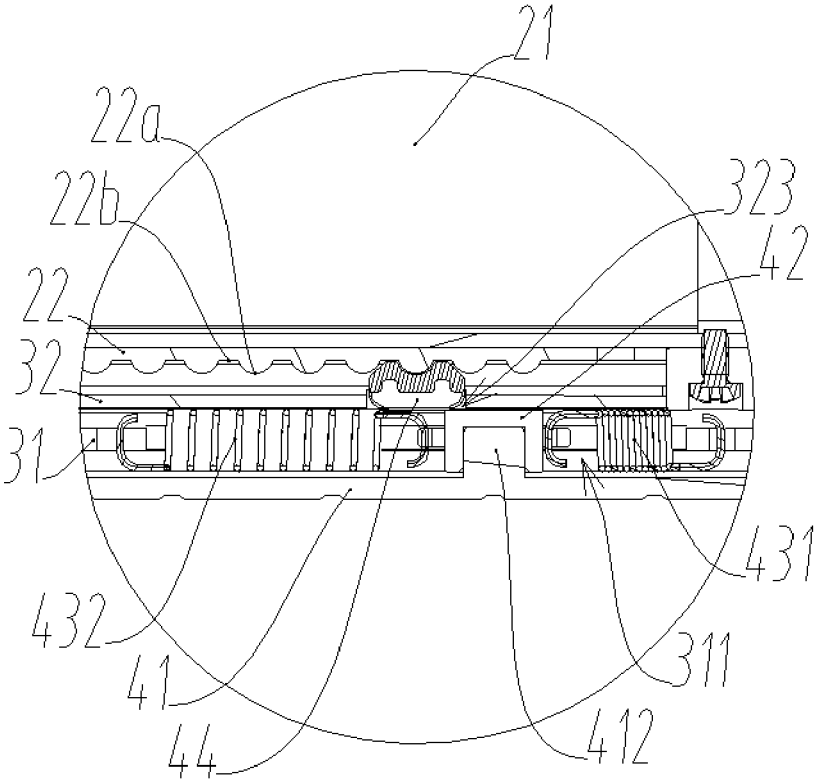
FIG. 15 is an enlarged view of area B in FIG. 13, in which the telescopic tube is in a first released state.

As shown in FIGS. 3, 7, 8 and 17, the locking block 44 is mounted in the third slot 323 and may optionally slide in the radial direction of the telescopic tube device 1. The body of the locking block 44 has a first surface of the locking block, the surface facing the slotted band 22. In the embodiment, the first surface of the locking block is provided in parallel with a first raised portion 4411 and a second raised portion 4412. The first raised portion 4411 and the second raised portion 4412 are constructed as strip-shaped protrusions extending in a direction perpendicular to the axis L, and a strip-shaped recessed portion 442 extending in a direction perpendicular to the extending direction of the axis L is formed between the first raised portion 4411 and the second raised portion 4422. A first raised portion bevel 4411*a* is provided on the side of the first raised portion 4411, the side being away from the recessed portion 442, and a second raised portion bevel 4412*a* is provided on the side of the second raised portion 4412, the side being away from the recessed portion 442. As shown in FIG. 14, when the first tube assembly 2 and the second tube assembly 3 do not slide relative to each other, the locking block 44 is engaged with the slotted band 22. Specifically, the first raised portion 4411 and the second raised portion 4412 are clamped into two adjacent locking slots 22*b*, and the slot spacing portion 22*a* between the two adjacent locking slots 22*b* is clamped into the recessed portion 442. If the locking block 44 is limited, the first tube assembly 2 and the second tube assembly 3 cannot slide relative to each other due to the engagement between the locking block 44 and the slotted band 22. If the locking block 44 is not limited and can slide in the radial direction of the telescopic tube device 1 and away from the axis L, and disengage from the slotted band 22, the first tube assembly 2 and the second tube assembly 3 can slide relative to each other. In other embodiments, one, three, or more than three strip-shaped raised portions may be provided. Raised edges 440 are symmetrically provided on two sides of the body of the locking block 44 in a direction perpendicular to the extending direction of the axis L, and the raised edges 440 extend in a direction away from the first surface of the locking block. A raised edge first bevel 4401*a* and a raised edge second bevel 4401*b* are provided at two ends of the raised edge 440 in the extending direction of the axis L. The inclination of the raised edge first bevel 4401*a* is adapted to the inclination of the raised edge second bevel 4221*b*, and the inclination of the raised edge second bevel 4401*b* is adapted to the inclination of the fin portion first bevel 4221*a*.

The operating unit 4 further includes at least one elastic member. When the limiting member is offset from the initial position, the elastic member always provides the limiting member with a pulling force, so that the limiting member has a tendency to move toward the initial position. In the embodiment, the elastic member includes a first spring 431 and a second spring 432. The first spring 431 and the second spring 432 are constructed as coil springs of the same specification, the first spring 431 has at two ends thereof a first connecting portion of the first spring 431*a* and a second connecting portion of the first spring 431*b*, and the second spring 432 has at two ends thereof a second connecting portion 432*a* of the second spring and a second connecting portion 432*b* of the second spring. The first connecting portion of the first spring 431*a*, the second connecting portion of the first spring 431*b*, the first connecting portion of the second spring 432*a*, and second connecting portion of the second spring 432*b* are all constructed as hook structures. The first spring 431 is disposed in the first slot 311 and between a first hole 3121 and the third connecting portion 4211, the first connecting portion of the first spring 431*a* is connected to the first hole 3121, and the second connecting portion of the first spring 431*b* is connected to the third connecting portion 4211. The second spring 432 is disposed in the first slot 311 and between a second hole 3122 and the fourth connecting portion 4212, first connecting portion of the second spring 432*a* is connected to the fourth connecting portion 4212, and second connecting portion of the second spring 432*b* is connected to the second hole 3122. Since the first spring 431 and the second spring 432 have the same specification, the slider 42 is in the central position of the first slot 311, that is, at the initial position of the slider 42. In the embodiment, when the slider 42 is at an initial position, the first spring 431 and the second spring 432 are in a stretched state, that is, the first spring 431 and the second spring 432 provide the slider 42 with equal pulling forces in opposite directions. Further preferably, when the slider 42 is offset from the initial position, the first spring 431 and the second spring 432 are always in the stretched state When the telescopic tube device is in a locked state, the limiting member is at an initial position, and the first locking member and the second locking member remain engaged; and when the telescopic tube device is in at least one released state, the limiting member is offset from the initial position, and the first locking member and the second locking member are disengaged.

For the convenience of description, the operation process of the telescopic tube device 1 of the embodiment is described in the orientations as shown in the drawings. The "upper", "lower", "left", and "right" mentioned below refer to the orientations shown in the drawings, and do not limit the technical solution of the present disclosure.

In the embodiment, when the slider 42 is at the initial position, as shown in FIGS. 10, 14, 17, 20 and 21, the position of slider 42 corresponds to the position of third slot 323, the fin portions 4221 abut against the raised edges 440 to limit the locking block 42 by means of the slider 44, so that the locking block 42 cannot slide in a direction away from the slotted band 22 and along the radial direction of the telescopic tube device 1, the locking block 42 and the slotted band 22 remain engaged, and the first tube assembly 2 and the second tube assembly 3 cannot slide relative to each other.

When not operated, the telescopic tube device 1 remains locked. When the user needs to retract the telescopic tube device 1, one hand holds the first tube assembly 2 (usually holds the handle assembly 5), and the other hand pushes the push button 41 to slide to the left (close to the first tube assembly 2) as shown in FIGS. 11, 15, 22 and 23. The push button 41 drives the slider 42 to slide to the left in the first slot 311. When the slider 42 slides to the left, the pulling force of the first spring 431 to the slider 42 increases, and the pulling force of the second spring 432 to the slider 42 decreases, that is, the resultant force of the first spring 431 and the second spring 432 to the slider 42 is rightward and gradually increases. When the slider 42 slides to the left, the slider 42 is gradually offset from the initial position thereof, and gets out of the way for the locking block 44 to slide down in the third slot 322. After the push button 41 slides to a limit position in the left (the limit position in the left may be defined by the sliding connection structure of the push button 41, or the sliding connection structure of the slider 42, or the length of the first slot 311, or the minimum length of the first spring 431 and the second spring 432), the user continues to apply the force that drives the push button 41 to slide to the left, and the operating unit 4 transfers the force to the second tube assembly 3 because the sliding of the push button 41 is limited, so that the second tube assembly 3 has a tendency to slide closer to the handle assembly 5 along the axis L. Since the limiting on the locking block 44 is released, the left side surfaces of the first raised portions 4411 and the second raised portions 4412 are subject to the reactive force of the locking slots 22*b* and the slot spacing portions 22*b*, the locking block 44 is disengaged from the slotted band 22, and the locking block 44 slides downwards along the third slot 323, so that the first tube assembly 2 and the second tube assembly 3 can slide relative to each other, and the telescopic tube device 1 is in the first released state. If the user continues to apply the force that drives the push button 41 to slide to the left, the first tube assembly 2 and the second tube assembly 3 can be retracted relative to each other. When the assemblies are retracted to proper lengths, the user releases the force on the push button 41, the slider 42 slides to the initial position under the action of the first spring 431 and the second spring 432, and the fin portion first bevels 4221*a* apply a rightward force to the raised edge second bevels 4401*b*, so as to push the locking block 44 to slide upwards and along the third slot 323 and then engage with the slotted band 22. When the slider 42 returns to the initial position, the fin portions 4221 abut against the raised edges 440, so that the locking block 44 remains engaged with the slotted band 22, and the telescopic tube device is restored to the locked state.

Figure 12:
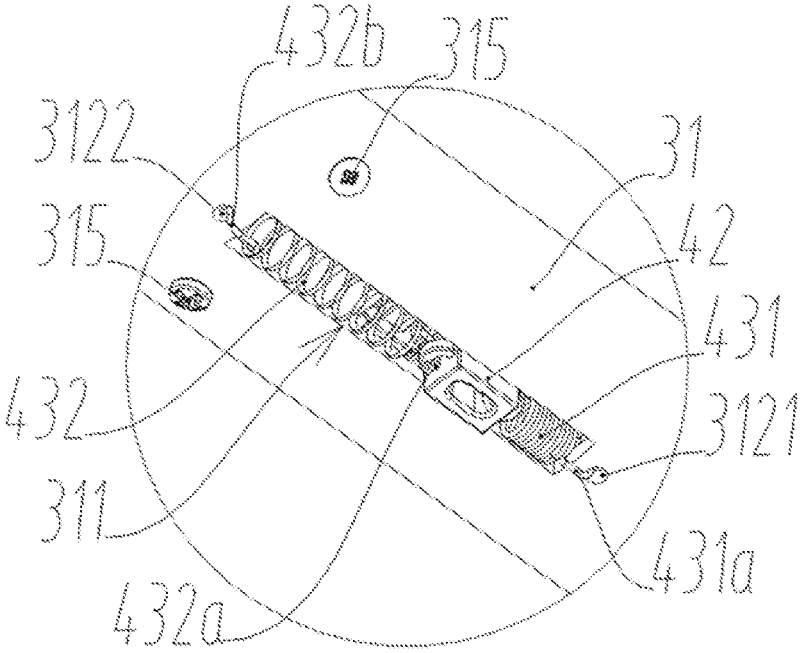
FIG. 12 is an enlarged view of area A in FIG. 9, in which the telescopic tube is in a second released state.
Figure 13:
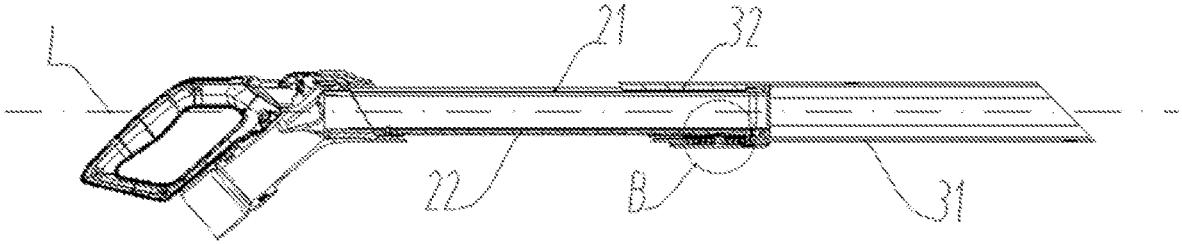
FIG. 13 is a sectional view of the telescopic tube according to a specific embodiment of the present disclosure.
Figure 16:
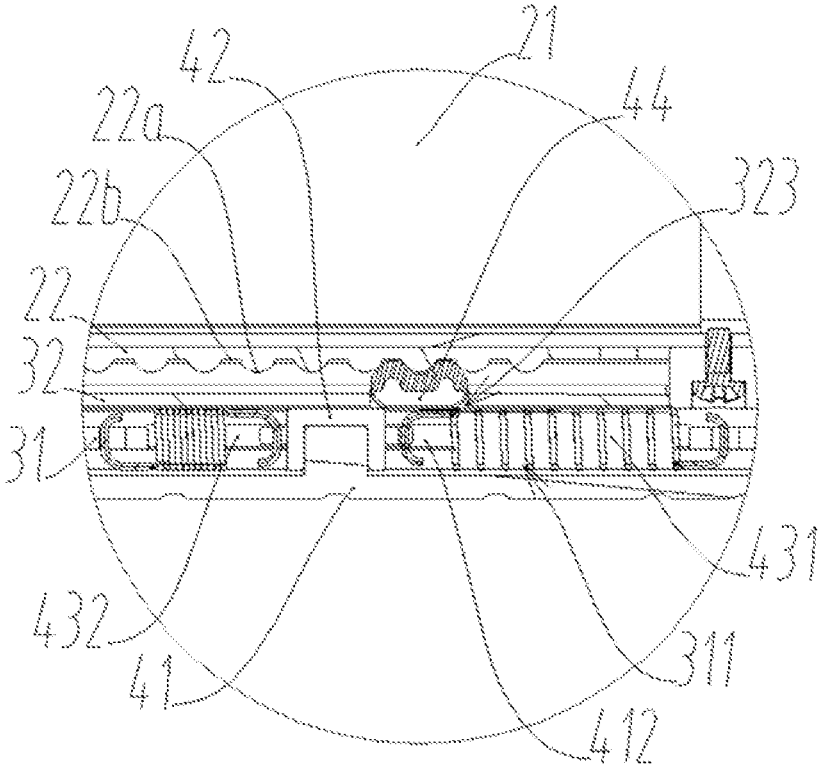
FIG. 16 is an enlarged view of area B in FIG. 13, in which the telescopic tube is in a second released state.

When the user needs to extend the telescopic tube device 1, one hand holds the first tube assembly 2 (usually holds the handle assembly 5), and the other hand pushes the push button 41 to slide to the right (away from the first tube assembly 2), as shown in FIGS. 12 and 16. The push button 41 drives the slider 42 to slide to the right in the first slot 311. When the slider 42 slides to the right, the pulling force of the second spring 432 to the slider 42 increases, and the pulling force of the first spring 431 to the slider 42 decreases, that is, the resultant force of the first spring 431 and the second spring 432 to the slider 42 is leftward and gradually increases. When the slider 42 slides to the right, the slider 42 is gradually offset from the initial position thereof, and gets out of the way for the locking block 44 to slide downward in the third slot 322. After the push button 41 slides to a limit position in the right (the limit position in the right may be defined by the sliding connection structure of the push button 41, or the sliding connection structure of the slider 42, or the length of the first slot 311, or the minimum length of the first spring 431 and the second spring 432), the user continues to apply the force that drives the push button 41 to slide to the right, and the operating unit 4 transfers the force to the second tube assembly 3 because the sliding of the push button 41 is limited, so that the second tube assembly 3 has a tendency to slide away from the handle assembly 5 along the axis L. Since the limiting on the locking block 44 is released, the right side surfaces of the first raised portions 4411 and the second raised portions 4412 are subject to the reactive force of the locking slots 22*a* and 22*b* to disengage the locking block 44 from the slotted band 22, and the locking block 44 slides down along the third slot 323, so that the first tube assembly 2 and the second tube assembly 3 can slide relative to each other, and the telescopic tube device 1 is in the first released state. The user continues to apply the force that drives the push button 41 to slide to the right, the first tube assembly 2 and the second tube assembly 3 can be extended relative to each other. When the assemblies extended to proper lengths, the user releases the force on the push button 41, the slider 42 slides to the initial position under the action of the first spring 431 and the second spring 432, and the fin portion second bevels 4221*b* apply a leftward force to the raised edge first bevels 4401*a*, so as to push the locking block 44 to slide upward along the third slot 323 and then engage with the slotted band 22. When the slider 42 returns to the initial position, the fin portions 4221 abut against the raised edges 440, so that the locking block 44 remains engaged with the slotted band 22, and the telescopic tube device is restored to the locked state.

With the telescopic tube device 1 of the present disclosure, the user only needs to continuously push the push button 4 in the direction in which the second tube assembly 3 is expected to move, and the telescopic operation of the telescopic tube device 1 can be completed. Meanwhile, tension springs are used in the operating unit 4 of the telescopic tube device 1 of the present disclosure, and two ends of the tension springs are hooked to two ends of the same horizontal plane, so that the tension springs are unlikely to offset from the position thereof, the tension springs are stretched along a horizontal line and compressed relative to each other under the action of restoring force and have a tendency to restore to the natural state, and the phenomenon of instability caused by offset and bending easily occurred when compression springs are used is avoided. The elongated shape of the tension springs determines that they are more suitable for the locking device of the telescopic tube. Moreover, compared to the compression springs, the tension springs are more convenient and faster to mount.

The present disclosure also provides another embodiment, a vacuum cleaner including the telescopic tube device 1.

It should be understood that, although the Description is described according to the embodiments, but each embodiment does not include only one independent technical solution, the narrative manner of the Description is only for clarity, the Description shall be regarded as a whole for a person skilled in the art, and the technical solutions in the embodiments may also be properly combined to form other implementations that can be understood by a person skilled in the art.

A series of detailed descriptions set forth above are merely specific descriptions of the feasible embodiments of the present disclosure, and are not intended to limit the scope of protection of the present disclosure. Any equivalent embodiment or modification made without departing from the technical spirit of the present disclosure shall be included within the scope of protection of the present disclosure.

The invention claimed is:

1. A telescopic tube device comprising:

a first tube assembly;

a second tube assembly slidably connected relative to the first tube assembly;

an operating unit disposed at a sleeved position between the first tube assembly and the second tube assembly, the operating unit including an operating member, a first locking member, a second locking member, and a limiting member;

the first locking member being disposed on the first tube assembly and including at least two locking portions;

the second locking member and the limiting member being disposed on the second tube assembly;

the second locking member being configured to selectively abut against and engage with any of the locking portions of the first locking member so as to limit relative sliding between the first tube assembly and the second tube assembly;

the telescopic tube device when in a locked state, the limiting member being at an initial position, and the first locking member and the second locking member being engaged with each other;

the telescopic tube device when in at least one released state, the limiting member being offset from the initial position, and the first locking member and the second locking member being disengaged;

the operating unit further including at least one elastic member;

the limiting member when offset from the initial position, the at least one elastic member providing the limiting member with a pulling force, so that the limiting member has a tendency to remain at the initial position;

wherein the first tube assembly includes a first tube having a first end and a second end, the first end of the first tube being sleeved with the second tube assembly, the second end of the first tube being opposite to the first end of the first tube; and wherein the second tube assembly includes a second tube having a first end and a second end, the second end of the second tube being sleeved with the first tube assembly, the first end of the second tube being opposite to the second end of the second tube;

wherein the second tube body defines a first slot near the second end of the second tube, the first slot being configured as an elongated through slot penetrating the second tube body, the length extending direction of the first slot being identical to the extending direction of an axis L; and wherein the at least one elastic member includes a first spring and a second spring, the first spring and the second spring are coil springs of the same specification, the first spring and the second spring are disposed in the first slot, and the first spring and the second spring are disposed on two sides of the limiting member so that the limiting member is at a central position of the first slot, the central position being an initial position of the limiting member.

2. The telescopic tube device according to claim 1, wherein the at least one elastic member always provides the limiting member with a pulling force, so that the limiting member has a tendency to move toward the initial position.

3. The telescopic tube device according to claim 1, wherein the first end of the first tube includes a first end sleeve cooperating with the second tube assembly for preventing the first tube assembly and the second tube assembly from disengaging from each other when sliding relative to each other; and wherein the second end of the first tube includes a second end sleeve connected to a handle assembly.

4. The telescopic tube device according to claim 1, wherein the second end of the second tube includes a liner fixedly connected to the second tube body, the liner being sleeved on an inner side of the second tube near the second end of the second tube, and an outer diameter of the liner being smaller than an inner diameter of the second tube body.

5. The telescopic tube device according to claim 4, wherein the liner has a second end near the second end of second tube, and a first end opposite to the second end of the liner, an outer circumferential surface of the liner including a mating surface extending along an axis of the mating surface, an end of the mating surface near the first end of the liner defining a second slot, the second slot being configured as a non-through slot, a bottom surface of the second slot being parallel to the mating surface and but not being on a plane in which the mating surface is located.

6. The telescopic tube device according to claim 5, wherein the bottom surface of the second slot defines a third slot, the third slot being constructed as a through slot penetrating the bottom surface of the second slot, the third slot being closer to an end of the second slot nearer to the first end of the liner than to another end of the second slot nearer to the second end of the liner, and when the first tube assembly and the second tube assembly slide relative to each other the third slot always corresponds to the first locking member.

7. The telescopic tube device according to claim 6, wherein the second tube body is fixedly connected to the liner, a position of third slot substantially corresponds to a center of the first slot, a position of the second slot substantially corresponds to a position of first slot, and a length extending direction of the second slot is the same as that of the first slot.

8. The telescopic tube device according to claim 1, wherein the operating member is configured as a push button having a push button body, the push button body having a shape adapted to an outer circumferential surface of the second tube body, a second connecting portion being located at a substantially central position of a surface of the push button body facing the second tube body, the second locking member being fixedly connected to the second connecting portion, the second connecting portion is always within the first slot when the push button body slides.

9. The telescopic tube device according to claim 1, wherein the limiting member is configured as a slider, the slider being embeddable in the first slot and slidable along a length direction of the first slot.

10. The telescopic tube device according to claim 1, wherein the second locking member is configured as a locking block, the locking block being mounted in the third slot and sliding in a radial direction, and when the first tube assembly and the second tube assembly do not slide relative to each other, the locking block is engaged with the first locking member so that the first tube assembly and the second tube assembly cannot slide relative to each other.

11. The telescopic tube device according to claim 1, wherein when the limiting member is at the initial position, the first spring and the second spring are in a stretched state; and wherein when the limiting member is offset from the initial position, the first spring and the second spring are always in the stretched state.

12. The telescopic tube device according to claim 1, wherein the first locking member is configured as a strip-shaped slotted band, and the locking portions are at least two locking slots provided in the strip-shaped slotted band and arranged substantially in an extending direction of the axis L, the extending direction of the axis L being a radial direction of the first tube assembly and the second tube assembly.

13. The telescopic tube device according to claim 12, wherein a slot spacing portion is formed between the two locking slots, the slotted band has a first surface and a second surface substantially parallel to the first surface, and the second surface of the slotted band is attached to an outer circumferential surface of the first tube body.

14. A vacuum cleaner including the telescopic tube device according to claim 1.

* * * * *